United States Patent [19]

Knox

[11] 4,188,632

[45] Feb. 12, 1980

[54] REAR FEED ASSEMBLIES FOR AERIALS

[75] Inventor: Dennis M. Knox, Felixstowe, England

[73] Assignee: Post Office, London, England

[21] Appl. No.: 830,139

[22] Filed: Sep. 2, 1977

Related U.S. Application Data

[63] Continuation of Ser. No. 649,975, Jan. 19, 1976, abandoned.

[30] Foreign Application Priority Data

Jan. 21, 1975 [GB] United Kingdom ..... 2580/75

[51] Int. Cl.[2] ..... H01Q 19/08; H01Q 19/18

[52] U.S. Cl. ..... 343/753; 343/781 P

[58] Field of Search ..... 343/781 CA, 781 D, 783, 343/786, 837, 840, 753

[56] References Cited

U.S. PATENT DOCUMENTS 3,071,770 1/1963 Wilkes ..... 343/781 P 3,611,391 10/1971 Bartlett ..... 343/755

3,806,941 4/1974 Cheal ..... 343/756

FOREIGN PATENT DOCUMENTS 814921 6/1959 United Kingdom ..... 343/781

*Primary Examiner*—Eli Lieberman

*Attorney, Agent, or Firm*—Hall & Houghton

[57] ABSTRACT

A rear feed assembly for a microwave aerial, comprising a dielectric support member having an energy reflecting surface positioned against one face thereof. Waveguide means is connected with the support, the center of the waveguide aperture being the phase center of the assembly and the said face of the support being located in the far field region with respect to that center. The support is so shaped that energy emitted from the waveguide means is reflected from the reflecting surface and emerges through a second face of the support with a spherical wavefront centered on the image phase center.

7 Claims, 8 Drawing Figures

REAR FEED ASSEMBLIES FOR AERIALS

This is a continuation of application Ser. No. 649,975, filed Jan. 19, 1976, now abandoned.

This invention relates to rear feed assemblies for aerials and has particular reference to rear feed assemblies for aerials operable at the higher microwave frequencies.

At those frequencies, the rear feed parabolic aerial is attractive because it is possible to employ a relatively simple feed system comprising a self-supporting feed passing from equipment behind the aerial through the vertex to the focal region of the aerial. It has been proposed to use as a rear feed a circular waveguide terminating in a dielectric-support for a splashplate. Such a construction is suitable for use at frequencies in the lower gigahertz range. With the previous proposals it is found that the feed may have more than one phase centre which causes an interference pattern to appear in the radiation pattern in the feed.

Accordingly, it is an object of the present invention to provide a rear feed assembly which is more efficient than prior proposals.

The present invention provides a rear feed assembly for a microwave aerial, comprising a support member formed of dielectric material and having first and second faces; waveguide means connected with the support member, the centre of the aperture at the end of the waveguide means being the phase centre of the assembly, and an energy reflecting surface positioned against the first face of the support member, the first face being located in the far field region with respect to the phase centre, and the first and second faces being so shaped that energy emitted from the waveguide means reflected from the reflecting surface and emerging from the support member through the second face has a spherical wavefront centred on an image phase centre.

The first face of the support member may be plane or it may be of generally conical form.

In one embodiment of the invention, the second face of the support member is part of a sphere centred on the image phase centre. In another embodiment, the distance between the image phase centre and the reflecting surface is less than that between the phase centre and the reflecting surface.

To enable the feed to be matched to the waveguide, an identation may be formed at the centre of the first face of the support member.

The support member may have a central stem extending therefrom, by which the support member is coupled to the waveguide means.

By way of example only, embodiments of the invention will now be described in greater detail with reference to the accompanying drawings of which:

FIG. 1 shows in vertical cross-section a simple embodiment of the invention in diagrammatic form only.

The embodiment is for use with a paraboloid main aerial of conventional form which will not be described for that reason.

A circular waveguide 1 connects with a dielectric support 2 carrying an energy reflecting surface, or splashplate, 3. The splashplate is a circular metallic disc whilst the support 2 is made of polyethylene or other suitable plastics material. The surface 4 of the support 2 to which the splashplate 3 is secured is, of course, in this case plane.

Figure 1:
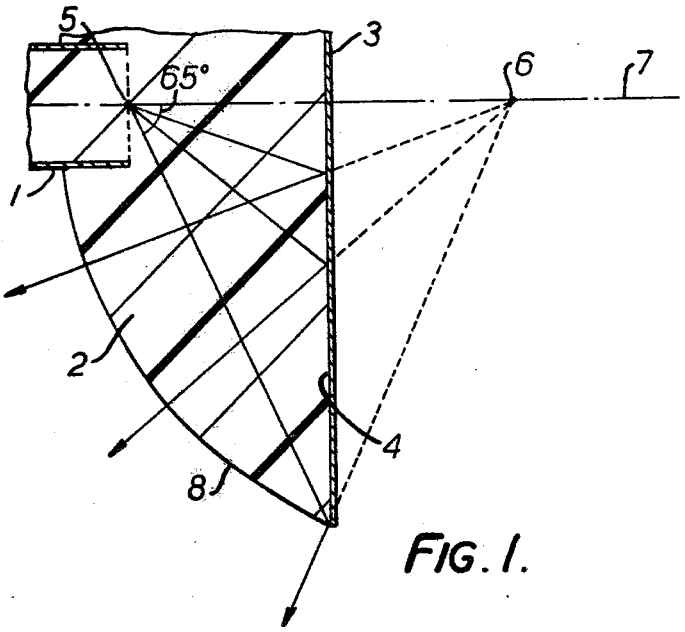
FIG. 1 is a vertical cross-section of a first embodiment.

It is assumed, in FIG. 1, that emission of radiation from the waveguide 1 is effectively from a single phase centre located centrally in the waveguide aperture. It is appreciated that the phase centres for the E and H plane patterns are frequently not coincident, but the errors in assuming coincidence are usually very small. The centre is indicated at 5 in FIG. 1. The splashplate 3 is spaced from the phase centre 5 by a distance sufficient to allow radiation from the waveguide to assume a spherical wavefront before it reaches the splashplate. That is to say, the splashplate 3 is in the far field region with respect to the phase centre 5. Thus, the distance between phase centre 5 and the plane containing the splashplate 3 is not less than $8a^2/\lambda_e$ where a is the radius of the waveguide mouth and $\lambda_e$ is the wavelength in the dielectric support 2.

Under these conditions an image phase centre is formed at 6 on the axis 7 which passes centrally through the waveguide and the splashplate and geometric ray optics can now be used to evaluate the radiation pattern. The path lengths of each of the rays from the phase centre 5 to the splashplate 3 and back to the surface 8 are equal with the result that the surface 8 of the support 2 is part of a sphere centred at the image phase centre 6.

In terms of feed diameter FD, the distance between the phase centre 5 and the splashplate 3 is about 2.0 FD, while the diameter of the splashplate is about 8 FD.

It will be appreciated that by comparison with prior proposals, the splashplate is further from the phase centre and consequently the diameter of the splashplate has to be increased if the bulk of the radiation emitted from the phase centre is to be reflected back to the main aerial surface (not shown). If the diameter of the splashplate is about 8 FD, the result is that all emitted radiation within 65° of the axis 7 is reflected back.

Shaping of the second face of the dielectric so as to change the distance between the image phase centre and the splashplate has the effect of changing the illumination pattern of the main aerial. Increasing the distance between the image phase centre and the splashplate decreases the angle of illumination of the main aerial and whilst this is, in general, not desirable, it can be used to correct the radiation pattern of a feed with an excessive spillover and so achieve an acceptable illumination of a given paraboloid main aerial. Variation of the angle of illumination of the main aerial arises from refraction at the surface 8 of the dielectric support 2 because that surface 8 is not then part of the surface of a sphere centred on the image phase centre.

Figure 2:
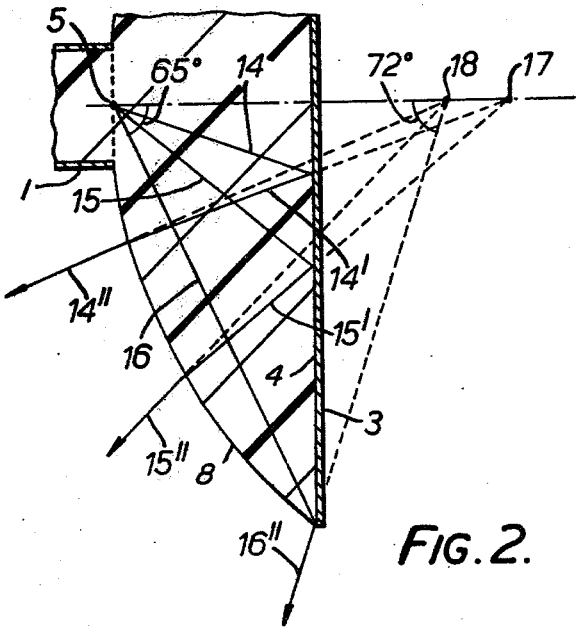
FIG. 2 is a vertical cross-section of a second embodiment.

FIG. 2 is a vertical section of an embodiment of the invention in which the image phase centre is moved by modifying the surface contour of the surface 8.

Rays emanating from the phase centre 5 strike the splashplate 3 and are reflected back as indicated by the lines 14, 14'; 15, 15'. If the surface 8 is contoured in the manner described above with reference to FIG. 1, then an image phase centre would be formed at 17, this being the point at which the lines 14', 15' converge.

The contour of surface 8 can be modified to produce a degree of refraction at the surface such that the emerging rays indicated by lines 14", 15" and 16" now converge at a new image phase centre 18 that is closer to the splashplate 3 than image feed centre 17.

The change in the contour of surface 8 increases the illumination pattern of the main aerial from, in the illustrated embodiment, 65° to 72°.

The technique just described can be used to correct a radiation pattern that is too narrow for a particular paraboloid.

Reshaping the dielectric so as to bring the image phase centre closer to the splashplate has a further advantage. Equal increments of the angle of incidence of energy on the splashplate give rise to increments in angle of emergence from the dielectric which are not equal, those nearer the axis being increased by greater amounts than those more remote from the axis. There is, therefore, some degree of re-distribution towards the periphery of the main aerial of energy emitted towards it by the splashplate. The gain factor of the main aerial is thus improved.

In the modification just described, it has been stated that the surface 8 of the dielectric support 2 is not part of the surface of a sphere centred on the image phase centre. It follows that reflections from the surface are distributed in much the same way as from a tapered transformer and this results in an improved impedance match of the feed.

Further, there is some internal reflection at the surface 8 of radiation emitted from the phase centre 5 when the distance between the latter and the splashplate 3 is decreased and this results in a reduction of "spillover" as compared with previous proposals.

The precise profile of the surface 8 of the dielectric support can be varied to meet different requirements provided that the electrical lengths of any two paths from the waveguide phase centre 5 to the splashplate 3 and back to a spherical wavefront centred on the image phase centre 6 and passing through the surface 8 are equal. For convenience of summing the path length of paths in air and dielectric, the electrical length of a path in air is taken as the physical length divided by the refractive index (i.e. the square root of the dielectric constant) of the dielectric.

In the embodiment described above with reference to FIG. 1, the surface 8 coincides with a spherical wavefront centred upon the image phase centre 6 but this is not essential provided the limitation in the preceding paragraph is observed.

It is possible by modifying the contour of surface 8 to correct the different phase centres of the E and H plane radiation patterns. The surface 8 in the E plane may be so shaped to position the image phase centre at a particular point. If the H plane image phase centre is not located at that point, the surface 8 can be so shaped to move the H plane phase centre to that point. The dielectric support is then not a solid of revolution about the axis 7 and consequently cannot be made by normal turning methods. However, it is relatively easy to produce the support by a moulding process.

Figure 3:
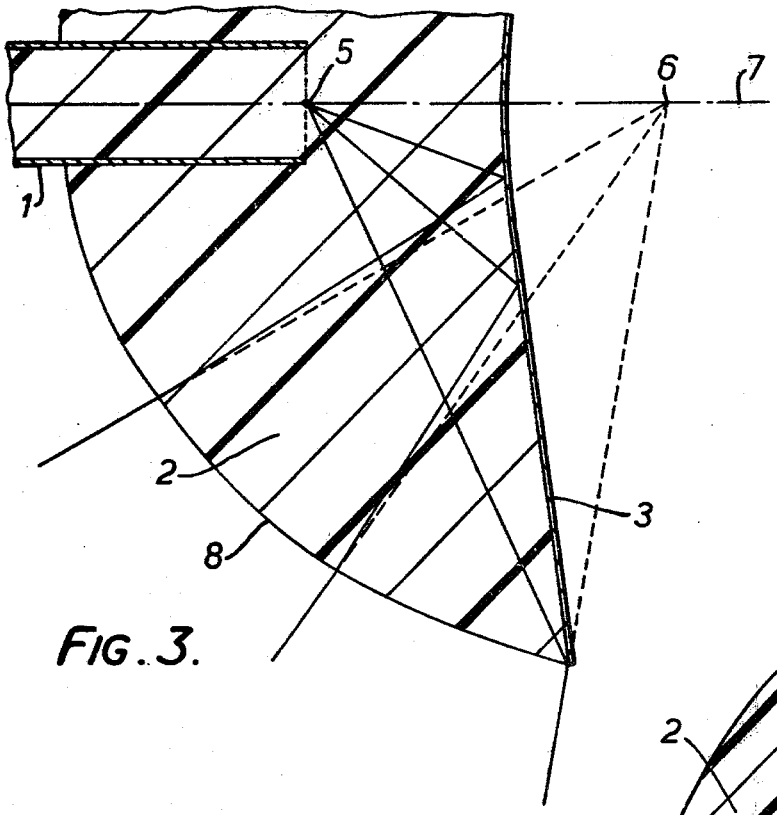
FIG. 3 is a vertical cross-section of a third embodiment.

In a further embodiment of the invention shown in FIG. 3, the splashplate 3 is of a conical form. This has the advantage of increasing the angle of illumination of the main aerial, of reducing blockage by the waveguide aperture and improving the gain of the aerial. The refractive index of the dielectric of which the support 2 is made is used to move the image phase centre from a point off the axis 7 (it is actually, a ring centre when the arrangement is considered in 3-dimensions) to a point on the axis.

The size of the splashplate and of the support 2 are materially greater in the embodiment of FIG. 3 than in the embodiment of FIG. 1. This has the unfortunate result of increasing the blockage of the main aerial by the support and splashplate but there may be applications in which this is acceptable.

Figure 7:
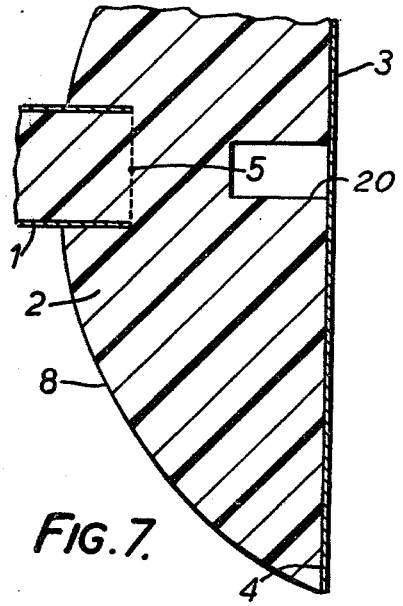
FIGS. 7 and 8 are vertical cross-sections of two further embodiments.
Figure 8:
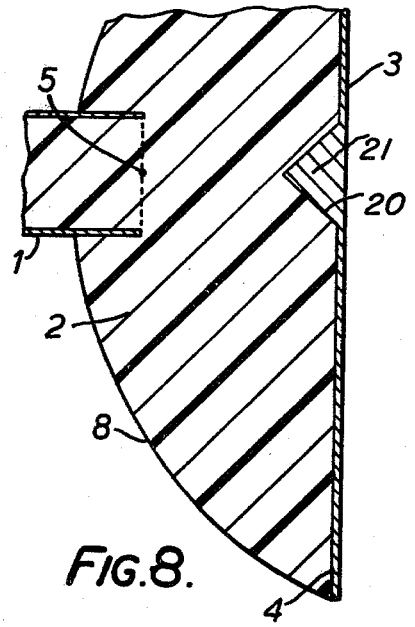

FIGS. 7 and 8 illustrate two further embodiments which are generally similar to that shown in FIG. 1 but in each of which an indentation 20 is formed in the support 2 at the centre of the surface 4 to enable the splashplate feed to be matched to the waveguide 1. The identation may be cylindrical, as shown in FIG. 7, or it may be of generally conical form, as shown in FIG. 8. In either case, the splashplate 3 may remain plane so that the indentation 20 is air-filled as shown in FIG. 7. Alternatively, in either case, the splashplate 3 may be formed with a protuberence 21 (FIG. 8) which fills the indentation. The matching of the splashplate feed to the waveguide may be adjusted by means of a metal screw (not shown) located in the indentation: this screw may also be used to secure the splashplate to the support 2.

For ease of manufacture it is preferred, as has been stated above, to employ a dielectric support that is a solid of revolution about the axis 7. This also simplifies the design procedure and makes it possible to use orthogonal, linear or circular polarization. It is also preferred to couple the feed assembly to a circular waveguide although it is possible to use both square or rectangular waveguides as feeders.

To couple the feed assembly to the waveguide feed the support member 2 has a central rod-like protuberance which extends into the waveguide, the end of the protuberance being tapered to improve matching.

Figure 4:
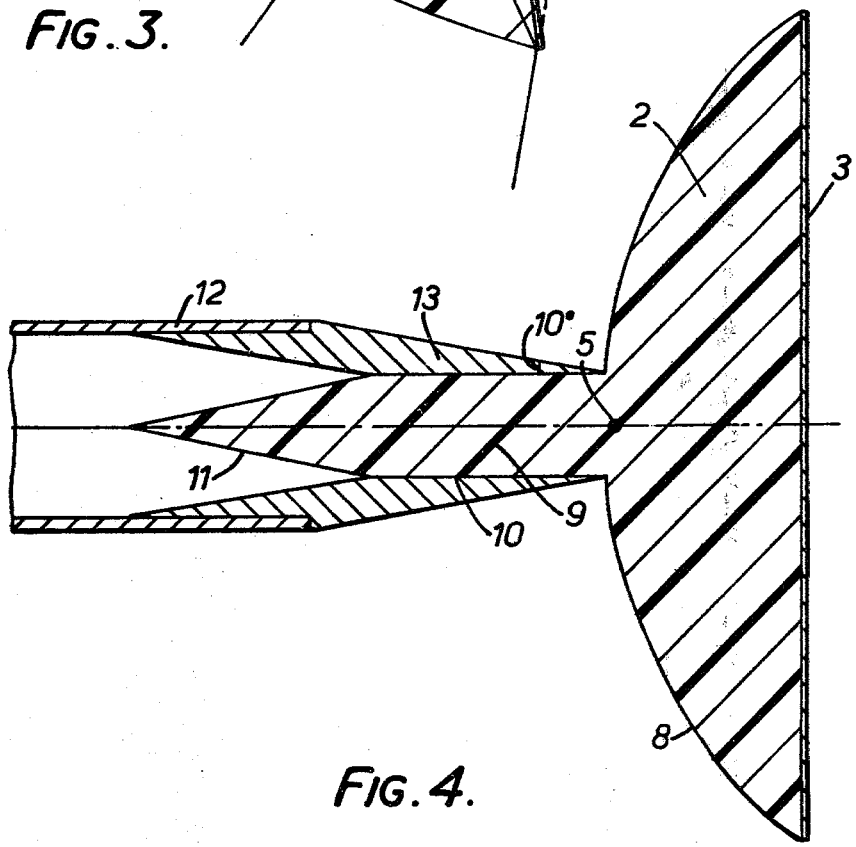
FIG. 4 is a vertical cross-section of a fourth embodiment.

FIG. 4 shows details of one way in which coupling is achieved. The support member 2 has a central, rod-like extension 9 which has a portion 10 over which the diameter of the extension is constant and an end-portion 11 which is tapered to a point at the end remote from the splashplate 3. The feed assembly is shown coupled to a circular waveguide 12 whose diameter exceeds that of the portion 10. The tapered portion 11 is almost wholly located within the waveguide and coupling is completed by a brass insert 13 tapered externally and internally as at 14 and 15 respectively from the waveguide diameter to that of the portion 10.

The taper of insert 13 matches the larger internal diameter of the waveguide 12 to the smaller external diameter of the extension 9. Preferably, the diameter of the portion 10 of the extension lies within the range of from $0.65$–$0.95\lambda_e$ where $\lambda_e$ is the wavelength in the dielectric and must not fall below $0.586\lambda_e$ at which value cut-off occurs.

The dielectric material used, in the embodiment of FIG. 4, for the support 2 is polyethylene whose dielectric constant is 2.25. Thus, the wavelength of radiation in the dielectric is related to that of radiation in free space by the equation $$\lambda_e = 0.667\lambda_o$$

where $\lambda_e$ is the wavelength in the dielectric and $\lambda_o$ is the wavelength in free space.

The diameter of the waveguide can now be fixed. It remains to determine the distance between the splashplate and the waveguide phase centre and the contour of the surface 8 of the support 2. Because the maximum distance is limited by the surface 8 meeting the waveguide at the waveguide aperture, the maximum value of the distance is first found from simple geometrical relations and from electrical path length considerations of rays emanating from the waveguide centre, assumed, in the case of the embodiment of FIG. 4 to be at the root of the extension 9, i.e. at 5.

The profile of the surface 8 is then evaluated by similar geometrical considerations.

Figure 5:
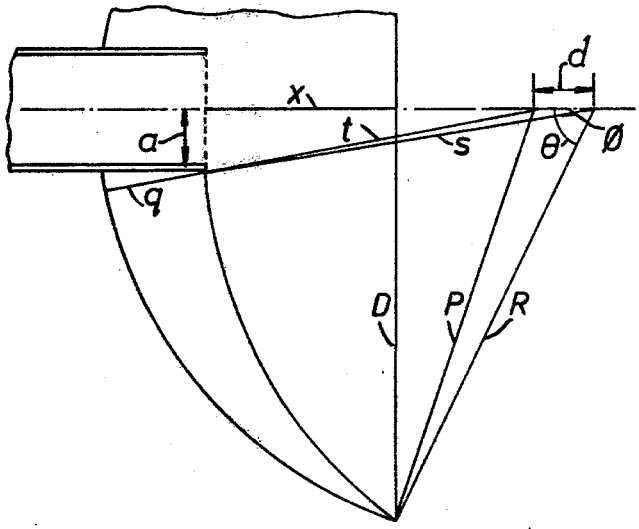
FIGS. 5 and 6 are explanatory diagrams.

The position of maximum displacement of the image phase centre from the position in which the surface 8 lies on a spherical wavefront centred on the image phase centre is calculated in the following way:

The ray geometry diagram is shown in FIG. 5.

The radius of a waveguide aperture, the distance x of the splashplate from the waveguide, the half angle $\theta$ subtended by the splashplate and the dielectric constant e are in general either known or chosen for a particular design. A set of simple equations may be set up of which the last three are three simultaneous equations with three unknowns p, t and d.

$$\phi = \arctan a/2x$$

$$R = x \sec \theta$$

$$D = x \tan \theta$$

$$s = \sqrt{a^2 + (2x)^2}$$

$$q = (R - s)\sqrt{e}$$

$$p = q + t \quad (1)$$

$$t = \sqrt{u^2 - (2x - d)^2} \quad (2)$$

$$p^2 = D^2 + (x - d)^2 \quad (3)$$

Substituting (2) in (1) and the resultant in (3) the following equation is obtained $$[q + \sqrt{a^2 + (2x - d)^2}]^2 = D^2 + (x - d)^2$$

from which may be formed the quadratic equation:

$$\left(1 - \frac{x^2}{q^2}\right)d^2 - 2x\left(2 + \frac{D^2 - 3x^2 - c^2 - a^2}{2q^2}\right)d - \left(\frac{D^2 - 3x^2 - q^2 - a^2}{2q}\right)^2 + 4x^2 \div a^2 = \theta$$

The value of d obtained from this equation is the maximum value it can assume with the given values of a, x, $\theta$ and e. It ensures that the surface of the dielectric lens meets the waveguide at the waveguide aperture.

Figure 6:
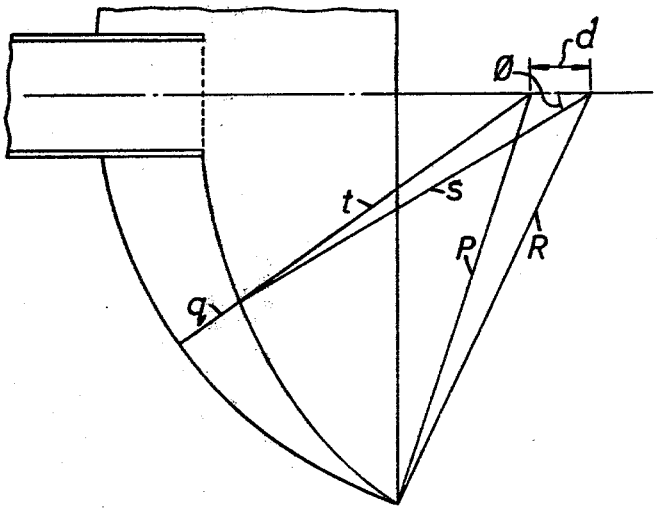

The necessary geometry for deriving the profile of the surface 8 is shown in FIG. 6. From electrical path length considerations the following equations may be formed:

$$s + q/\sqrt{e} = R \quad (4)$$

$$q = p - t \quad (5)$$

$$t^2 = s^2 + d^2 - 2sd \cos \phi \quad (6)$$

from which $$s^2 + d^2 - 2sd \cos \phi = (\sqrt{e}s - \sqrt{e}R + p)^2$$

$$s = \frac{[2eR - 2\sqrt{ep} - 2d\cos\phi] + \sqrt{[2\sqrt{ep} + 2d\cos\phi - 2eR]^2 - 4(e-1)[(p - \sqrt{eR^2} - d^2]}}{2(e-1)}$$

The surface contour can, of course, be expressed in polar purposes to use cartesian co-ordinates related to a well defined and measurable plane.

I claim:

1. A splash plate feed assembly for a microwave aerial comprising a support member of a dielectric material, the member having a convex front face facing the aerial and a rear face facing away from the aerial, an energy reflecting planar surface positioned against said rear face, waveguide means coupled to said support member, the waveguide means having a circular aperture at one end, the centre of the aperture forming the phase centre of the assembly and the distance between said phase centre and said reflecting surface being not less than $8a^2/\lambda_e$ where a is the radius of the waveguide aperture and $\lambda_e$ is the wavelength of microwave radiation in the support member a plurality of radiation paths extending from said phase centre to said energy reflecting surface and back through said convex face, said support member being so shaped that the electrical lengths of said paths from said phase centre to a spherical wavefront centred on the image phase centre are equal and the dimensions of said energy reflecting surface being at least 8 times the diameter of said waveguide means to ensure that all radiation emitted by the waveguide means within 65° of the axis thereof is reflected by said surface.

2. A splash plate feed assembly as claimed in claim 1 in which an indentation is formed at the centre of the said rear face.

3. A splash plate feed assembly as claimed in claim 2 in which the indentation is of cylindrical form.

4. A splash plate feed assembly as claimed in claim 2 in which the indentation is of conical form.

5. A splash plate feed assembly as claimed in claim 2 in which the reflecting surface has a protuberance which fills the indentation.

6. A splash plate feed assembly as claimed in claim 1 in which the dielectric constant of the dielectric material is not less than 2.0.

7. A splash plate feed assembly as claimed in claim 1, in which the convex front face of the support member lies substantially on a spherical wavefront centred on the image phase centre.

* * * * *